US006684771B2

(12) United States Patent
Detmers et al.

(10) Patent No.: US 6,684,771 B2
(45) Date of Patent: Feb. 3, 2004

(54) PRINTING PRESS HAVING A CENTRAL PLATE CYLINDER

(75) Inventors: Andreas Detmers, Heddesheim (DE); Arno Juenger, Nussloch (DE); Juergen Kreutzkaemper, Sinsheim-Hoffenheim (DE); Sven Mader, Dielheim (DE); Christian Meier, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/288,850

(22) Filed: Nov. 6, 2002

(65) Prior Publication Data

US 2003/0121432 A1 Jul. 3, 2003

(30) Foreign Application Priority Data

Nov. 21, 2001 (DE) ..... 101 57 060

(51) Int. Cl.[7] ..... B41F 5/16

(52) U.S. Cl. ..... 101/177; 101/176; 101/217; 101/232

(58) Field of Search ..... 101/176, 177, 101/183, 217, 232, 7; 271/275

(56) References Cited

U.S. PATENT DOCUMENTS

| | | | | |
|---|---|---|---|---|
| 4,011,812 A | | 3/1977 | Julian Lecha | 101/176 |
| 5,353,703 A | | 10/1994 | Rieker | 101/177 |
| 5,526,107 A | * | 6/1996 | Bronstein | 399/299 |
| 5,727,462 A | * | 3/1998 | Castegnier | 101/211 |
| 5,908,541 A | * | 6/1999 | Castegnier | 204/486 |
| 6,125,751 A | | 10/2000 | Korem | 101/180 |
| 6,393,987 B1 | | 5/2002 | Bolza-Schuenemann | 101/483 |

FOREIGN PATENT DOCUMENTS

| | | |
|---|---|---|
| DE | 286056 | 3/1913 |
| DE | 322846 | 1/1914 |
| DE | 515616 | 12/1930 |
| DE | 1038065 | 9/1958 |
| DE | 19723147 | 12/1998 |
| DE | 19813030 | 9/1999 |
| DE | 10035354 | 2/2001 |
| DE | 10040980 | 3/2001 |
| GB | 369187 | 9/1930 |
| JP | 6012754 | 7/1985 |
| JP | 04074650 | 3/1992 |

OTHER PUBLICATIONS

H. Kipphahn: "Handbook of Print Media", Section 2.1.3.3 pp. 281–282; Springer Publishers, 2000.

Xerox DocuColor 40 printing system description; http://www.xerox.com.

* cited by examiner

*Primary Examiner*—Daniel J. Colilla
*Assistant Examiner*—Jill E Culler
(74) *Attorney, Agent, or Firm*—Davidson, Davidson & Kappel, LLC

(57) ABSTRACT

A novel, inexpensive and compact printing press is provided, having a central plate cylinder (1) including at least two printing plates (5) mounted on the peripheral side, around which are arranged in a satellite configuration at least two blanket cylinders (3) having assigned inking units (7), including a transport device (13), which loops around the blanket cylinder (3) on the outside, in the manner of a closed, continuous belt, having printing sheets, which are pressed for the printing operation by compensating rollers (15) against blanket cylinders (3), and having a control unit (11), which engages the particular inking unit (7) and the blanket cylinder (3) on the corresponding printing plate (5) and lifts it off of the other printing plate(s) (5).

9 Claims, 1 Drawing Sheet

PRINTING PRESS HAVING A CENTRAL PLATE CYLINDER

Priority to German Patent Application No. 101 57 060.0, filed Nov. 21, 2001 and hereby incorporated by reference herein, is respectfully requested.

BACKGROUND INFORMATION

The present invention is directed to a printing press for multi-color printing, having a central plate cylinder.

From German Patent Application No. 197 23 147, a method and a device are known for driving a printing press having at least one integrated imaging device. To attain a high imaging speed, the drive of the printing form cylinder is released from the drive gear train; the printing form cylinder is driven by its own drive in the imaging operation at imaging speed; and, in a service position phase, the drive of the printing form cylinder is integrated in the drive gear train. In this context, each offset cylinder can be equipped on the peripheral side with two active areas, and two inking units and one imaging device can be assigned to each printing form cylinder. The offset cylinders are mounted on the peripheral side around the single impression cylinder.

The printing press described in German Patent Application No. 197 23 147 is further refined in the German Patent Application No. 100 35 354. In this printing press, a multiplicity of inking rollers of a dedicated ink-application unit is able to be brought into contact with a predefined plate section on a plate cylinder, and, additionally, the inking rollers are able to disengaged from a remaining plate section on the plate cylinder.

Also known from German Patent Application No. 100 40 980 is a transport device which has retention and guiding means for holding and guiding the sheets at the outer edges in a defined position, as well as for keeping them taut toward the outer sides. The forces required in this instance can be generated, at least in part, electrostatically.

Also generally known is the satellite printing principle that provides for the print units to be assigned in a satellite configuration to a shared impression cylinder (H. Kipphahn:"Handbook of Print Media", Section 2.1.3.3 pp. 281–82; Springer Publishers, 2000).

The known printing presses require many expensive cylinders, so that their manufacture entails substantial outlay.

The DocuColor 40 printing system from Xerox is also known. It features a gripper-free conveyance of the printing sheets via electrostatic forces and a conveyor belt.

BRIEF SUMMARY OF THE INVENTION

An object of the present invention is to provide a novel, inexpensive and compact printing press.

The present invention provides a printing press for multi-color printing, having a central plate cylinder (1), having at least two printing plates (5) mounted on the peripheral side, around which are arranged in a satellite configuration at least two blanket cylinders (3) having assigned inking units (7), including a transport device (13), which loops around the blanket cylinder (3) on the outside, in the manner of a closed, continuous belt, having printing sheets, which are pressed for the printing operation by compensating rollers (15) against the blanket cylinders (3), and having a control unit (11), which engages the particular inking unit (7) and the blanket cylinder (3) on the corresponding printing plate (5) and lifts it off of the other printing plate(s) (5).

Costs are able to be saved, in particular, because of the ability to economize on laser modules and impression cylinders. An inexpensive, uncomplicated, and compact printing press having only one plate cylinder is realized in a satellite type of construction.

One preferred specific embodiment provides that, for four-color printing, the printing press have four printing plates on the peripheral side, as well as, correspondingly, four blanket cylinders. In this context, one blanket cylinder is provided for each color, making possible a simple, reliable, and compact printing press design.

Due to cost considerations, the number of imaging units assigned to the single plate cylinder having up to four printing plates may be limited to one.

At least one of the compensating rollers may be configured between the plate cylinder and the transport unit, to render possible a most compact possible type of construction of the printing press.

The transport device advantageously has a conveyor belt which is electrostatically chargeable for purposes of conveying the sheets. This unifies the paper guidance and counter-pressure cylinders, due to the use in the statically chargeable belt. An exceptionally compact type of construction is able to be achieved as a result of the paper guidance provided by the conveyor belt and the integration of the counter-pressure cylinders in the same belt.

As described in German Patent Application No. 100 40 980, the transport device may optionally have retention and guide means to hold and guide the sheet in defined positions, in the area of its outer edges running in parallel to the conveyance direction; and means may be additionally provided for keeping the sheets taut toward the outer sides. This enables the individual sheets of a substrate to be printed on without the need for a flat supporting surface, such as a continuous belt. In the context of a one-sided processing, damage to the other side of the sheet caused by the action of resting on a belt is avoided, in particular. The forces necessary for retention and guidance may be implemented mechanically, magnetically and/or electrostatically, as discussed in the German DE 100 40 980.

BRIEF DESCRIPTION OF THE DRAWING

On the basis of schematized representations, an exemplary embodiment of the printing press according to the present invention is described in the following; in greatly simplified form, the single Figure.

DETAILED DESCRIPTION

Figure 1:
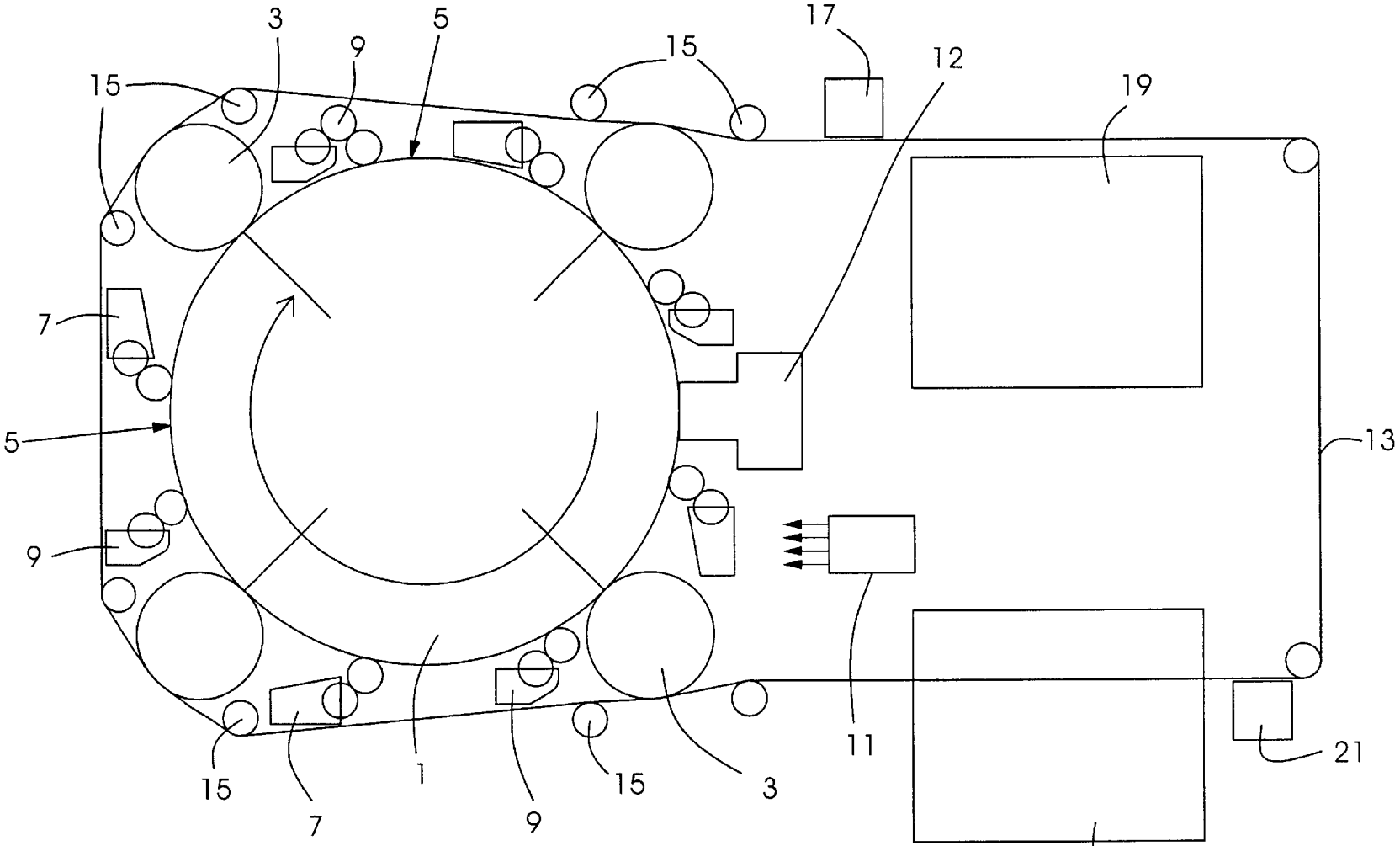
FIG. 1, shows a basic representation of the printing press according to the present invention.

In the center of the printing press is an x-times large plate cylinder 1 for an x-color machine. Mounted at the periphery of the plate cylinder in a satellite configuration are four blanket cylinders 3, which, at each rotation of plate cylinder 1, engage on a corresponding printing plate 5 for purposes of ink transfer and are subsequently immediately lifted off again. To this end, four printing plates 5 are clamped on the peripheral side to the plate cylinder. Each printing plate 5 or each blanket cylinder 3 has its own inking unit 7, as well as a damping unit 9 assigned thereto. For reasons of space requirements, inking units 7 are designed as generally known short inking units having cartridges. During printing operation, inking and damping units 7, 9, respectively, are likewise suitably engaged on and disengaged from corresponding printing plates 5 of plate cylinder 1. An appropriate control unit 11 is provided for controlling the movements of blanket cylinders 3, as well as of inking and damping units 7, 9. This control unit is able to control motion, in the manner described, for example, in German Patent Application No. 100 35 354, which is hereby incorporated by reference herein. In addition, an imaging unit 12 is assigned to plate cylinder 1. Because of the multiple printing-plate configuration on plate cylinder 1, the need is eliminated for further laser modules.

The sheet conveyance is handled by an electrostatically chargeable conveyor belt 13, which simultaneously assumes the function of counter-pressure cylinders; for this reason, belt 13 has a rugged design, in order to be able to absorb the high tensile stresses occurring during the printing operation. Two compensating rollers 15 at each blanket cylinder 3 assume the function of compensating for belt lengths. This is necessary due to the engaging and disengaging of blanket cylinders 3. In this context, the control is carried out in such a way that, as the result of actuation of blanket cylinders 3, there is no effect on the adjacent print unit. In addition, compensating and/or pressure rollers 15 ensure an always same angle of wrap at each of blanket cylinders 3. Two pairs of compensating rollers 15 are mounted between plate cylinder 1 and conveyor belt 13, in order to increase the distance between plate cylinder 1 and belt 13. In this manner, the illustrated compact configuration of inking and damping units 7, 9 is achieved.

Subsequently to the electrical discharging of conveyor belt 13, the sheets are delivered by an unloader 17 to a delivery pile 19. Prior to the feeding of new sheets, conveyor belt 13 is again electrostatically charged by a belt-charging unit 21. The feeding operation may be carried out, for example, as shown in the Figure, a feeder 23 placing the sheets on conveyor belt 13. Alternatively, the sheets may also be advanced by a belt deviation from below, or the sheets may be conveyed by a transport device in accordance with German Patent Application No. 100 40 980, which is also hereby incorporated by reference herein, in which case For special printing material (stock) and/or higher grams per $m^2$, additional counter-pressure cylinders may optionally be provided for the printing press.

REFERENCE SYMBOL LIST

1 plate cylinder
3 blanket cylinder
5 printing plate
7 inking unit
9 damping unit
11 control unit
12 imaging unit
13 conveyor belt
15 compensating rollers
17 unloader
19 delivery pile
21 belt-charging unit
23 feeder

What is claimed is:

1. A printing press for multi-color printing, comprising:

a central plate cylinder having a peripheral surface and having at least two printing plates mounted on the peripheral surface, the at least two printing plates including a first printing plate and a second printing plate;

at least two blanket cylinders arranged in a satellite configuration around the plate cylinder, the at least two blanket cylinders including a first blanket cylinder and a second blanket cylinder, a first inking unit assigned to the first blanket cylinder and a second inking unit assigned to the second blanket cylinder;

a transport device looping around the blanket cylinder on the outside, the transport device including a closed, continuous belt for transporting sheets and including compensating rollers contacting the belt, the sheets being pressed for a printing operation by the belt against the blanket cylinders, and a control unit for engaging the first inking unit and the first blanket cylinder on the first printing plate and disengaging the first inking unit and the first blanket cylinder from the second printing plate and for engaging the second inking unit and second blanket cylinder on the second printing plate and disengaging the second inking unit and second blanket cylinder from the first printing plate.

2. The printing press as recited in claim 1 wherein the at least two printing plates include four printing plates and the at least two blanket cylinders includes four blanket cylinders.

3. The printing press as recited in claim 1 further including a single imaging unit assigned to the plate cylinder.

4. The printing press as recited in claim 1 wherein at least one compensating roller of the compensating rollers is assigned to each blanket cylinder.

5. The printing press as recited in claim 4 wherein at least one of the compensating rollers is mounted between the plate cylinder and the transport unit.

6. The printing press as recited in claim 1 wherein the first inking unit is a short inking unit.

7. The printing press as recited in claim 1 wherein the belt is electrostatically chargeable.

8. A printing press for multi-color printing, comprising:

a central plate cylinder having a peripheral surface and having at least two printing plates mounted on the peripheral surface, the at least two printing plates including a first printing plate and a second printing plate;

at least two blanket cylinders arranged in a satellite configuration around the plate cylinder, the at least two blanket cylinders including a first blanket cylinder and a second blanket cylinder, a first inking unit assigned to the first blanket cylinder and a second inking unit assigned to the second blanket cylinder;

a transport device looping around the blanket cylinder on the outside, the transport device including a retention and guiding device for transporting a sheet having outer edges and a front side and a rear side, the retention and guiding device holding and guiding the sheet in an area of the outer edges and keeping the sheet taut, and a control unit for engaging the first inking unit and the first blanket cylinder on the first printing plate and disengaging the first inking unit and the first blanket cylinder from the second printing plate and for engaging the second inking unit and second blanket cylinder on the second printing plate and disengaging the second inking unit and second blanket cylinder from the first printing plate.

9. A method for multi-color printing using a printing press having a central plate cylinder having a peripheral surface and having at least two printing plates mounted on the peripheral surface, the at least two printing plates including a first printing plate and a second printing plate, the printing press also having at least two blanket cylinders arranged in a satellite configuration around the plate cylinder, the at least two blanket cylinders including a first blanket cylinder and a second blanket cylinder, a first inking unit assigned to the first blanket cylinder and a second inking unit assigned to the second blanket cylinder and a transport device looping around the blanket cylinder on the outside, the method comprising the steps of:

engaging the first inking unit and the first blanket cylinder on the first printing plate and disengaging the first inking unit and the first blanket cylinder from the second printing plate as the plate cylinder rotates; and engaging the second inking unit and second blanket cylinder on the second printing plate and disengaging the second inking unit and second blanket cylinder from the first printing plate as the plate cylinder rotates.

* * * * *